United States Patent [19]

Grandclement

[11] 4,236,131

[45] Nov. 25, 1980

[54] ELECTROMAGNET WITH PLUNGER-TYPE ARMATURE AND A METHOD FOR THE PRODUCTION THEREOF

[75] Inventor: Gérard Grandclement, Cap d'Ail, France

[73] Assignee: International Cold Forging Corporation, Monaco

[21] Appl. No.: 868,456

[22] Filed: Jan. 10, 1978

[30] Foreign Application Priority Data

Jan. 11, 1977 [MC] Monaco ..... 1225

[51] Int. Cl.[3] ..... H01F 7/08

[52] U.S. Cl. ..... 335/260; 335/278

[58] Field of Search ..... 335/250, 251, 260, 278, 335/52, 151, 202

[56] References Cited

U.S. PATENT DOCUMENTS 3,226,606 12/1965 Erickson ..... 335/260

3,757,263 9/1973 Saarem et al. ..... 335/260

FOREIGN PATENT DOCUMENTS 1074843 7/1967 United Kingdom ..... 335/260

*Primary Examiner*—Harold Broome

[57] ABSTRACT

An electromagnet and a method for the fabrication thereof are disclosed. The electromagnet is characterized by a coil form having a relatively thin wall whereby the winding thereabout is as close as possible to a portion of the magnetic circuit. The method of this invention provides for the insertion of magnetic hollow bodies into a coil form prior to winding the coil thereabout.

5 Claims, 6 Drawing Figures

ELECTROMAGNET WITH PLUNGER-TYPE ARMATURE AND A METHOD FOR THE PRODUCTION THEREOF

BACKGROUND OF THE INVENTION

1. Field of the Invention

The present invention relates generally to electromagnetic devices and more particularly to a method for manufacturing electromagnets with plunger-type armatures and the structural design of such electromagnets.

2. Description of the Prior Art

Electromagnets of this kind are preferably used for the actuation of solenoid valves or other switching devices. They facilitate the actuation of the valve or switching device as a function of their state of excitation by attraction or release of a spring-loaded, plunger type armature.

In general, electromagnets with plunger-type armatures, and especially such electromagnets as are employed in solenoids for washing machines, are provided with a coil form made of a suitable plastic material onto which is applied the copper wire coil winding. Subsequently, the position of the coil winding is protected by a plastic cover. The elements forming the magnetic circuit are assembled on the covered coil winding. In general, prior art electromagnets comprise a magnetic back circuit surrounding the coil and two, preferably cylindrical, hollow bodies which join both ends of the magnetic back circuit and continue on both sides into the interior of the coil.

This prior art manner of production of an electromagnet exhibits several shortcomings. For example copper wire used for the coil winding on the coil form must have sufficient strength so that it does not become deformed during or after the winding or, even worse, break. For this reason, the inner wall of the coil form must have sufficient thickness and strength. This, in turn, results in the placement of even inner windings of the coil at a sufficiently large distance from the magnetic elements in the interior of the coil form which leads to an additional magnetic loss. On the other hand, the magnetic back circuit which must be applied after the plastic sealing must be very large in volume in order to encircle the cast-on mass. All of this resulted in comparatively heavy and bulky prior art magnetic systems.

The two cylindrical hollow bodies within the coil opening must be rigidly connected with the magnetic back circuit in order to ensure good support and favorable magnetic properties of the complete circuit. This, in turn, necessitates very precise adjusting tolerances of all parts relative to one another. Moreover, the fastening means cause additional increase of the distance between the magnet elements and the coil wire, resulting in a further loss of magnetic energy and additional needs of material, especially copper wire in the prior art devices.

DESCRIPTION OF THE PRESENT INVENTION

It is the purpose of the present invention to provide an electromagnet and a method for production of said electromagnet which do not suffer from the aforementioned shortcomings. The electromagnet in accordance with the present invention functions in particular with a very thin interior wall of the coil form and its magnetic circuit extends as close as possible to the coil winding.

Accordingly, an electromagnet in accordance with the method of the present invention is produced by initially inserting the two magnetic hollow bodies prior to the winding of the coil. As a result, the thickness of the inner wall of the coil form can be decreased. Subsequently, the coil is wound and the magnetic back circuit is placed over the magnetic hollow bodies and around the coil body prior to the casting operation. The unit thus obtained is then covered with the encapsulating material.

Moreover, with the construction of an improved electromagnet according to the present invention, smaller losses becomes possible. The casting of the sealing material is simplified in that the previously assembled magnetic back circuit renders the entire assembly strong and accessible. On the cooling and setting, the copper wire which may be very thin is subjected to only small strains of the casting mass.

Further advantages which may be attained by way of the measures in accordance with the invention will be described below for an example of an embodiment and with the help of the attached drawings.

DESCRIPTION OF THE PREFERRED EMBODIMENT

Figure 1:
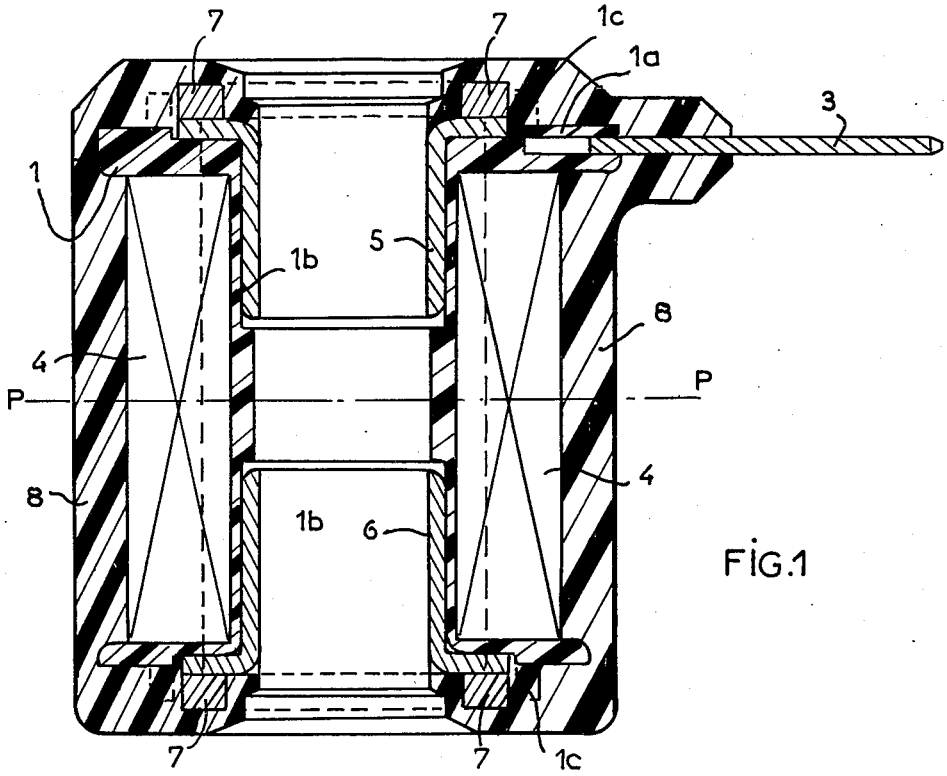
FIG. 1 is a sectional, elevational view illustrating a portion of an electromagnet in accordance with the present invention taken along line I—I indicated in FIG. 2.
Figure 2:
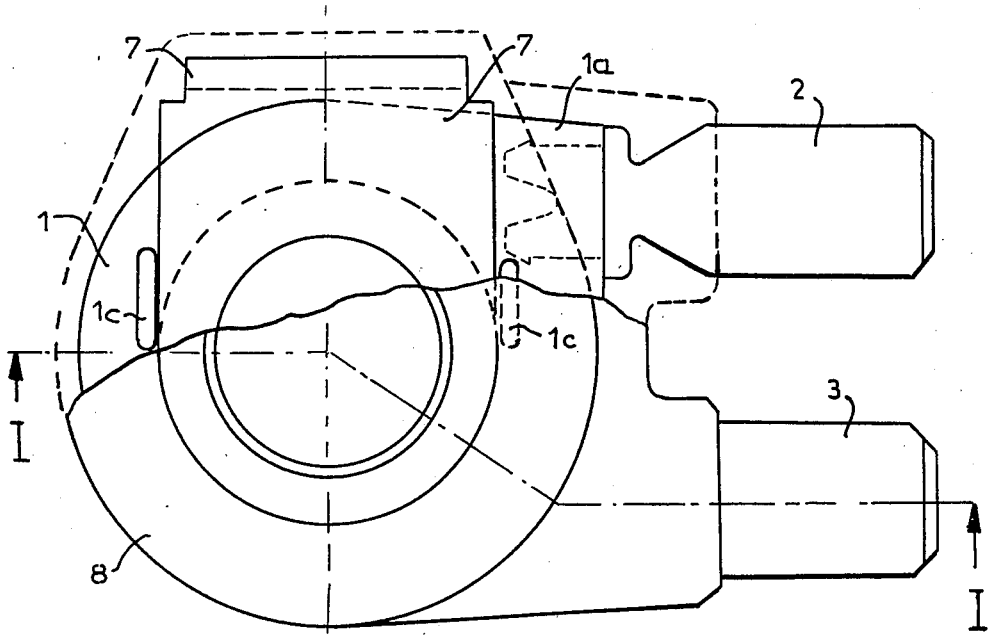
FIG. 2 is a partially broken away plan view of the electromagnet comprising the present invention whereby part of the encapsulating material has been removed for the sake of clarity.

FIGS. 1 and 2 illustrate the various components required to construct and produce an electromagnet in accordance with the invention. A coil form or body 1 made from a suitable plastic or other insulating material surrounds the axis of the electromagnet which is symmetrical except for that part which serves to accommodate terminals 2 and 3. The beginning and the end of the coil are fixed to the terminals 2 and 3. The coil winding itself is shown schematically and is designated by the reference character 4.

The coil form 1 has clearances or recessed bores for accommodating a pair of hollow bodies 5 and 6 made of a suitable magnetic material. The hollow bodies 5 and 6 are inserted into the clearances in the coil form 1 prior to application of the coil windings 4. The hollow bodies 5 and 6 can be introduced into the coil form 1 with very little friction. They are provided with a flat portion or flange serving as abuttment on the top and bottom of the coil body. The hollow bodies 5 and 6 mechanically reinforce the cylindrical interior of the coil form 1 and ensure that the diameter thereof is maintained during the winding of the wire under great tension and in spite of the very small thickness **1*b* of the wall of the coil body 1 about which the wire 4 is wound. The magnetic hollow bodies 5 and 6 are placed very close to the inner turns of the coil winding 4** so that magnetic losses in the cylindrical interior are substantially decreased.

Following the winding, a U-shaped magnetic back circuit 7 is slid over the transverse end faces of the coil body 1 with its lateral parts over the flat upper surfaces of the flanged portions of the magnetic hollow bodies 5 and 6 which project slightly beyond the lateral boundaries of the coil body 1.

The magnetic back circuit 7 extends transversely and is maintained by ribs 1c on the end faces of the coil body 1.

The assembly thus formed is subsequently encapsulated by or embedded in a plastic material injected under pressure into a mold. The cast-on mass of plastic material is designated by the reference character 8 in FIGS. 1 and 2. For the purpose of casting, the assembly comprising the coil form 1 with the windings 4 and the terminals 2 and 3, the magnetic hollow bodies 5 and 6 and the magnetic back circuit 7 is placed on a mold and maintained therein by means of the magnetic hollow bodies 5 and 6 in that portions of the mold wall are introduced into the cylindrical inner bore of the magnetic hollow bodies 5 and 6.

The cast mass of plastic material fully surrounds the entire unit except for the inner bore of the cylindrical hollow bodies 5 and 6 and thereby the coil form 1. Moreover, the ends of the terminals 2 and 3 also remain free. The forcing of the casting mass into the mold as well as the shrinking of the material 8 ensure good adhesion between the lateral parts of the magnetic back circuit 7 and the flat parts of the magnetic hollow bodies 5 and 6 so that flawless magnetic transition between these elements and small magnetic reluctance of the entire circuit are ensured.

On the other hand, this construction of the magnetic circuit inhibits the shrinkage of the embedding plastic material whereby at the same time the pressure on the copper winding and the pull on the fine wire are limited and thus, the risk of breaking of the wire on subsequent operation of the electromagnet is reduced.

Figure 3:
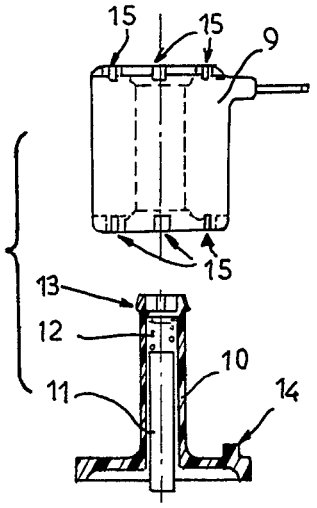
FIG. 3 is an exploded, elevational view illustrating the assembly of an electromagnet in accordance with the present invention on the upper part of a solenoid valve.

In order to illustrate an example of use, FIG. 3 shows in an exploded, elevational view, an example of an embodiment of an electromagnet unit 9 constructed in accordance with the invention for placement within a solenoid valve.

The upper tubular portion 10 of the solenoid valve is shown in cross section in order to illustrate the magnetic core 11 and the return spring 12.

For operating purposes, the electromagnet unit 9 is placed on the tubular body 10 of the solenoid valve in such a manner that the magnetic core 11 is placed in the strong magnetic field between the magnetic hollow bodies 5 and 6 and is subjected to the force of attraction of the electromagnet.

The electromagnet unit may be maintained on the tubular portion 10 of the solenoid valve by means of an outside seal 13 which is fastened to the uppermost end of the tubular element 10.

Figure 4:
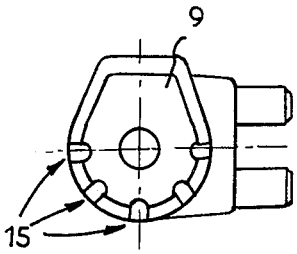
FIG. 4 is a plan view of an electromagnet as shown in FIG. 3.
Figure 5:
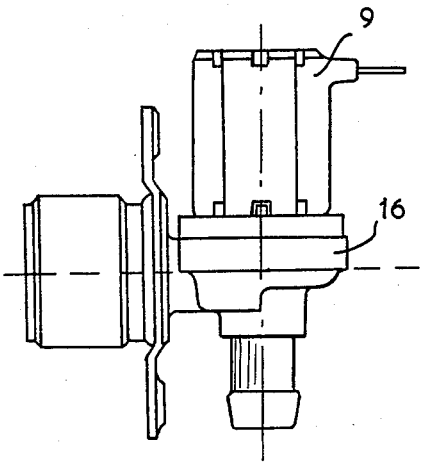
FIGS. 5 and 6 are elevational and plan views, respectively, of fully assembled solenoid valves with electromagnets in accordance with the present invention and approximately in actual size.

The electromagnet unit 9 is provided with slots or recesses 15 on its end surfaces and a flange on the tubular part 10 of the solenoid valve is provided with a projection 14 which is inserted into one of the slots 15 in order to prevent a turning of the electromagnet unit 9 relative to the valve. Several slots 15 are provided so that the electromagnet unit can be placed at various different angular positions. The electromagnet unit 9 is provided with slots 15 on both its end faces so that, depending on the space conditions of the machine, the connections can be rendered on top, such as shown in FIGS. 3 to 5, or also, if desired, on the opposite or bottom end. This advantage is obtained because the electromagnet unit 9 is constructed symmetrically, with respect to the magnetic circuit and the fastening on the valve, and relative to a transverse plane P—P indicated in FIG. 1.

Figure 6:
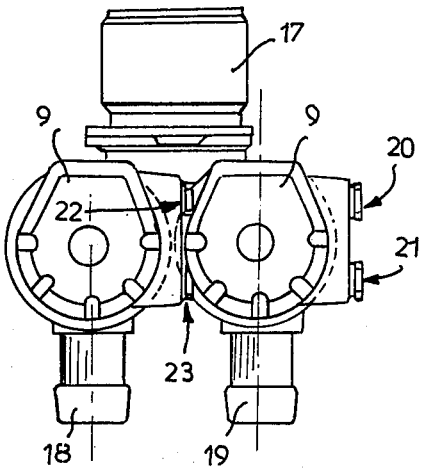

FIG. 6 represents, to scale, a solenoid valve with two connections 18 and 19 which are provided with two electromagnet units 9, thereby demonstrating a further advantage of the electromagnetic assembly 9 in accordance with the present invention, which resides in the decreased space requirement due to the compact construction of such an electromagnetic aggregate 9.

In this valve 17 the terminals are displaced by 90° relative to the longitudinal dimension of the valve, and the connecting lines of the two electromagnet units 9 which are designated by the reference characters 20, 21, 22 and 23 extend in the same direction so that in comparison with the customary multiple connection arrangements, a substantial reduction in space requirement is attained.

The present invention has been explained by illustrating a few possibilities of one embodiment which, however, do not limit the application of said invention. Rather, many variants may be utilized to advantage within the scope of the disclosure contained in the claims.

I claim:

1. An electromagnet with a plunger-type armature and guide means therefor, said electromagnet comprising:

an elongated, tubular body made of an insulating thermoplastic material and having a stepped bore therethrough that defines an annular, axially oriented wall which is thinner at the opposed ends thereof than in the central portion, said tubular body further including a radially extending flange at both axially opposed ends thereof;

a pair of hollow, magnetic bodies positioned, respectively, within said stepped bore at the axially opposed ends of said tubular body, each said hollow body having a radially outwardly directed flange that bears against one of said flanges of said tubular body;

a pair of laterally spaced apart, axially extending and generally chordally oriented ribs on each said flange of said body;

a U-shaped magnetic back circuit defined by a pair of spaced apart legs that rest on said flanges of said hollow bodies and which are contained between said ribs and a connecting portion extending between a common end of said legs, an opening being further provided in each said leg with said openings in said legs being coaxial with each other as well as with said hollow bodies and said tubular body when said legs are positioned over said flanges of said hollow bodies whereby the armature is slidingly received therein;

two terminals partially imbedded in one of said flanges of said tubular body;

electrically conductive coil means wound about said tubular body between said flanges thereof and attached to said terminals; and said insulating material encapsulating all of said electromagnet except the interior of said tubular body and said hollow bodies and the non-imbedded portion of said terminals.

2. The electromagnet in accordance with claim 1, wherein said two magnetic hollow bodies are provided with a plane, ring-shaped outer surface which extends slightly over the boundary surface of said coil form and onto which are placed the inner surfaces of the magnetic back circuit.

3. The electromagnet as in claim 1 wherein there is a symmetrical construction with respect to the formation of said magnetic circuit and to the fastening elements, relative to a transverse plane perpendicular to the axis of said wound coil whereby the assembly can be placed either directly or turned by 180° on a solenoid valve or other such device having a plunger-type armature.

4. The electromagnet as in claim 1 wherein said thermoplastic material is provided with a plurality of peripheral slots on the end surfaces of both sides, in order to facilitate the insertion of the plunger-type armature and its guide in various positions, to prevent turning and to fix said armature in the desired position.

5. The electromagnet in accordance with claim 1, wherein the length of said hollow magnetic bodies measured from said flange to the end of said bodies opposite said flange is approximately equal to the axial length of the thickness of said flange of said tubular body plus the axial length of the thinner wall section thereof.

* * * * *